US008622581B2

(12) United States Patent
Tsao

(10) Patent No.: US 8,622,581 B2
(45) Date of Patent: Jan. 7, 2014

(54) LIGHT GUIDING POLE AND ILLUMINATION ASSEMBLY USING SAME

(75) Inventor: Mei-Tsu Tsao, Taipei County (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 338 days.

(21) Appl. No.: 12/334,635

(22) Filed: Dec. 15, 2008

(65) Prior Publication Data

US 2009/0257229 A1 Oct. 15, 2009

(30) Foreign Application Priority Data

Apr. 10, 2008 (CN) ..... 2008 1 0300975

(51) Int. Cl.
*F21V 5/00* (2006.01)
*F21S 8/00* (2006.01)

(52) U.S. Cl.
USPC ..... 362/268; 362/331

(58) Field of Classification Search
USPC ..... 362/331, 268
See application file for complete search history.

(56) References Cited

U.S. PATENT DOCUMENTS

| | | | | |
|---|---|---|---|---|
| 6,773,150 | B2 * | 8/2004 | Giordani et al. | 362/518 |
| 7,159,997 | B2 * | 1/2007 | Reo et al. | 362/240 |
| 2004/0201980 | A1 * | 10/2004 | Fischer et al. | 362/84 |

FOREIGN PATENT DOCUMENTS

| | | | |
|---|---|---|---|
| JP | A-1986030009 | A | 2/1986 |
| JP | A-1988004897 | A | 1/1988 |
| JP | A-1989312521 | A | 12/1989 |
| JP | A-2005231073 | A | 9/2005 |
| JP | 2006-73250 | A | 3/2006 |
| JP | A-2006302622 | A | 11/2006 |
| TW | I233475 | | 6/2005 |

* cited by examiner

*Primary Examiner* — Sean Gramling
(74) *Attorney, Agent, or Firm* — Altis Law Group, Inc.

(57) ABSTRACT

A light guiding pole (22) is described. The light guiding pole (22) includes a base board (23) having a top surface (231), a bottom surface (232) and a main board (24) mounted to the top surface (231) of the base board (23). A first optic member (311) is arranged on the top surface, adjacent to the main board (24). The main board (24) arranges a second optic member (249) therein. Light emitted from a light source emits from the bottom surface after being sequentially refracted by the second optic member and the first optic member. An illumination assembly (20) using the light guiding pole (22) is also described.

17 Claims, 4 Drawing Sheets

LIGHT GUIDING POLE AND ILLUMINATION ASSEMBLY USING SAME

BACKGROUND

1. Field of the Invention

The present invention relates to a light guiding pole used in an illumination assembly.

2. Description of Related Art

With the ongoing development of photographic technology, illumination assemblies have become widely used in portable electronic devices to provide light to a keypad assembly or display screen.

Referring to FIG. 4, a typical illumination assembly 10 may include a light source 11 and a light guiding pole 12. The light guiding pole 12 includes a first end 121, an opposite second end 122 and a peripheral wall 123. The light source 11 is arranged adjacent to the first end 121 and used to irradiate light. The peripheral wall 123 has a zigzag reflecting surface 124. The light irradiated by the light source 11 penetrates into the light guiding pole 12 through the first end 121, and emits out of the light guiding pole 12 through the second end 122 after being reflected many times by the zigzag reflecting surface 124.

However, the light guiding pole 12 can only transmit light linearly. In addition, the intensity of the emitted light weakens after many reflections.

Therefore, there is room for improvement within the art.

BRIEF DESCRIPTION OF THE DRAWINGS

Many aspects of the light guiding pole and illumination assembly using same can be better understood with reference to the following drawings. These drawings are not necessarily drawn to scale, the emphasis instead being placed upon clearly illustrating the principles of the present light guiding pole and illumination assembly using same. Moreover, in the drawings like reference numerals designate corresponding sections throughout the several views.

DETAILED DESCRIPTION OF EXEMPLARY EMBODIMENT

Figure 1:
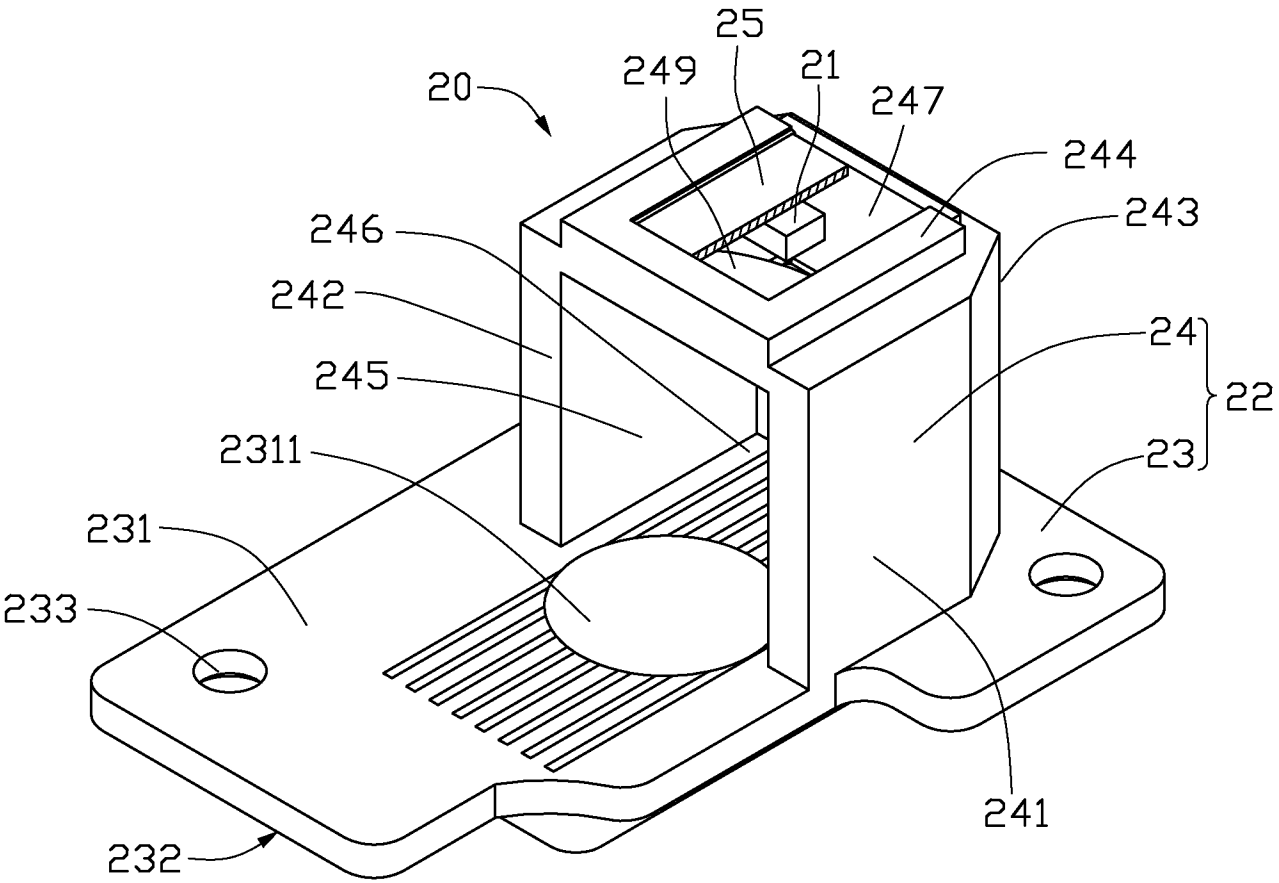
FIG. 1 is an isometric view of an illumination assembly, in accordance with an exemplary embodiment.
Figure 2:
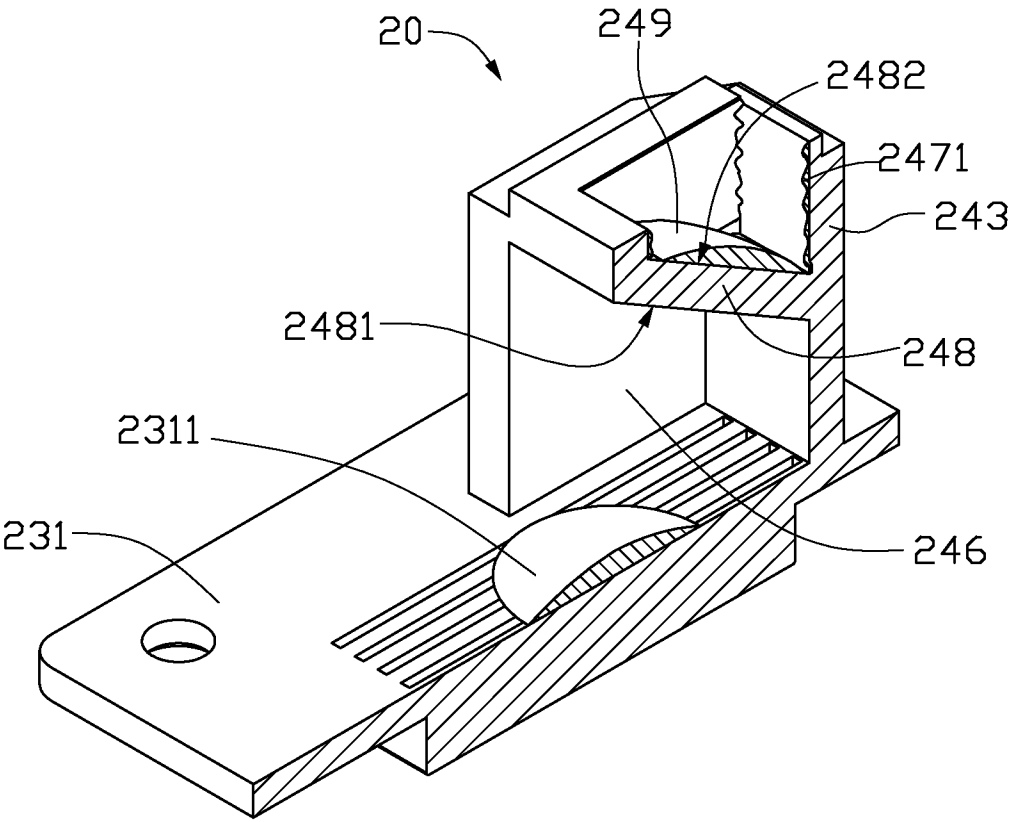
FIG. 2 is a cross-sectional, isometric view of a light guiding pole shown in FIG. 1.

FIGS. 1 and 2 show an exemplary illumination assembly 20 including a light source 21 and a light guiding pole 22.

The light source 21 may be a light emitting diode (LED) used to irradiate light. The light source 21 can be electrically mounted to a printed circuit board 25.

The light guiding pole 22 is generally L-shaped including a base board 23 and a main board 24. The main board 24 protrudes from the base board 23.

The base board 23 includes a top surface 231 and a bottom surface 232. A first optic member 2311 made of a film layer is attached (e.g., coated or printed) to the top surface 231. The first optic member 2311 may be a convex lens.

The main board 24 is generally hollow and includes a first wall 241, a second wall 242, a third wall 243 and an incident end wall 244. The first wall 241, the second wall 242 and the third wall 243 enclose a semi-enclosed cavity 246 with an opening 245 adjacent to the first optic member 2311. The incident end wall 244 has a rectangular receiving aperture 247 defined therein and an inclined separating wall 248 formed between the receiving aperture 247 and the cavity 246 (best seen in FIG. 2). The separating wall 248 and the second wall 242 may be made of transparent light guiding materials whose refractive index is generally equal to the refractive index of the atmosphere. Therefore, the refraction of light between the atmosphere, the second wall 242, and the separating wall 248 is greatly reduced or eliminated. A first surface 2481 facing the cavity 246 and an opposite second surface 2482 facing the receiving aperture 247. A second optic member 249 made of a film layer is attached (e.g., coated or printed) to the second surface 2482. The second optic member 249 may be a convex lens to transmit light from the light source 21 to the first optic member 2311. Then the first optic member 2311 focuses the light to emit from the bottom surface of the base board 23. The receiving aperture 247 receives the printed circuit board 25, and the light source 21 is positioned in the receiving aperture 247 facing the second optic member 249. A reflecting layer 2471 is attached (e.g., coated or printed) to the inner wall of the receiving aperture 247. The reflecting layer 2471 may have a waved cross-section and be configured to reflect light back to the second optic member 249.

Figure 3:
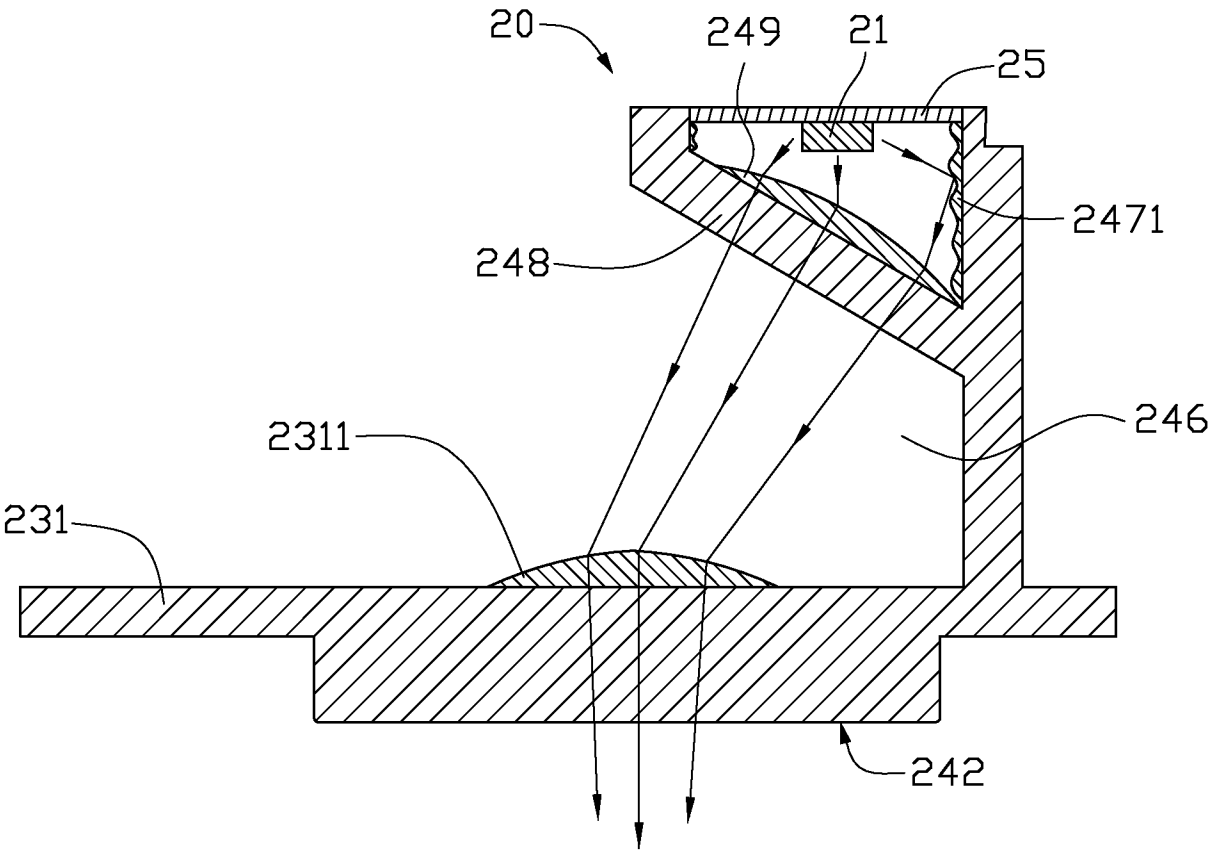
FIG. 3 is a schematic view showing an optical path of the illumination assembly shown in FIG. 1.
Figure 4:
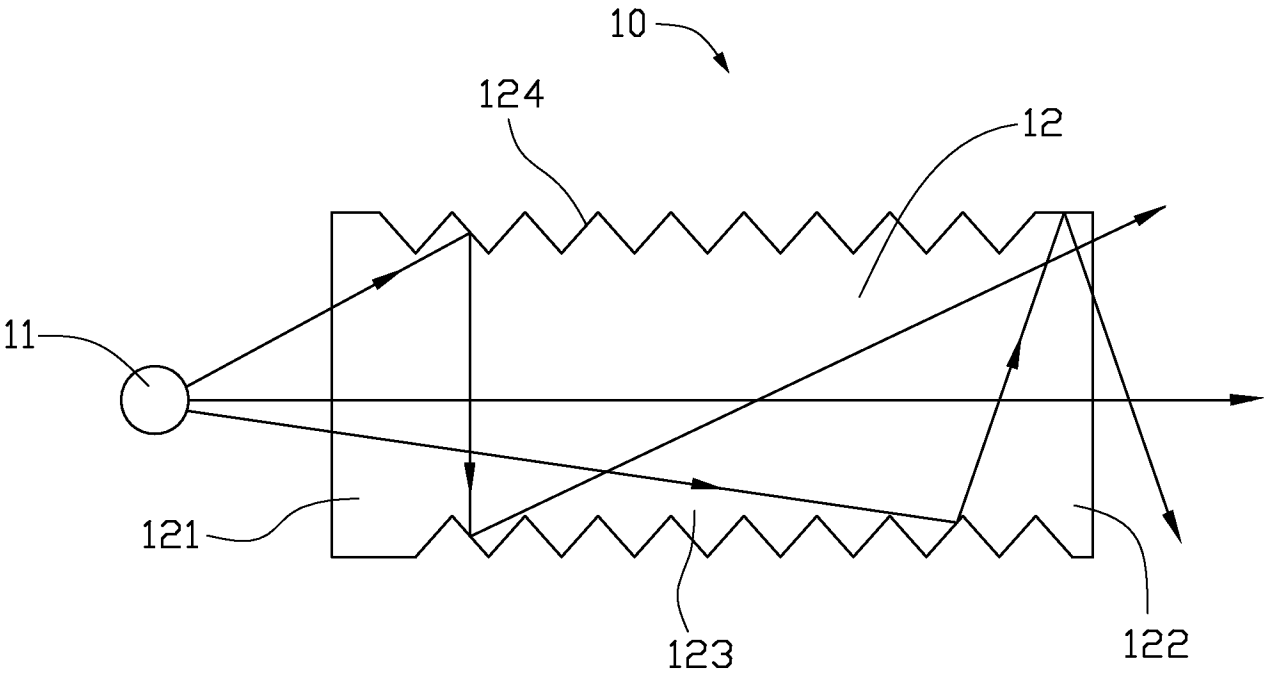
FIG. 4 (RELATED ART)
FIG. 4 is a schematic view of a typical illumination assembly.

Referring to FIG. 3, in use, most of the light irradiated by the light source 21 strikes on the second optic member 249 and the remainder of the light is reflected by the reflecting layer 2471 to the second optic member 249. The light reflected to the second optic member 249 is further refracted by the second optic member 249 and the first optic member 2311 in sequence to emit from the bottom surface 232.

Some advantages of the present embodiment are as follows. The first optic member 2311 and the second optic member 249 change transmitting path of light. Thus, the illumination assembly 20 can change the transmitting direction of light. Furthermore, most light has a relatively short transmitting distance during the illumination assembly 20, decreasing loss of light.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of sections within the principles of the invention to the full extent indicated by the broad general meaning of the terms, in which the appended claims are expressed.

What is claimed is:

1. A light guiding pole, comprising:

a base board having a top surface and a bottom surface, a first optic member being arranged on the top surface; and a main board mounted to the top surface of the base board, adjacent to the first optic member, the main board arranging a second optic member therein, wherein an optical axis of the first optic member is inclined with respect to an optical axis of the second optic member, light emitted from a light source emits from the bottom surface after being sequentially refracted by the second optic member and the first optic member;

wherein the main board defines a cavity, the main board has an incident end wall arranged away from the base board, the incident end wall defines a receiving aperture and forms a transparent inclined separating wall between the receiving aperture and the cavity, and the second optic member is arranged on the transparent inclined separating wall.

2. The light guiding pole as claimed in claim 1, wherein a reflecting layer is printed on the inner wall of the receiving aperture, and used to reflect a portion of the light to the second optic member.

3. The light guiding pole as claimed in claim 2, wherein the reflecting layer has a waved cross-section.

4. The light guiding pole as claimed in claim 1, wherein the first optic member is a convex lens.

5. The light guiding pole as claimed in claim 4, wherein:

the second optic member is a convex lens;

the first optic member comprising first and second opposite sides, a first convex portion having an apex on the first side thereof and a first planar portion on the second side thereof;

the second optic member comprising first and second opposite sides, a second convex portion having an apex on the first side thereof and a second planar portion on the second side thereof;

wherein the optical axis of the first optic member comprises a line perpendicular to the first planar portion and passing through the first apex and the optical axis of the second optic member comprises a line perpendicular to the second planar portion and passing through the second apex.

6. An illumination assembly comprising:

a light source used to irradiate light;

a printed circuit board, the light source mounted to the printed circuit board; and a light guiding pole including a base board and a main board, the base board having a top surface and a bottom surface, a first optic member being arranged on the top surface, the main board being mounted to the top surface the base board, adjacent to the first optic member, the main board arranging a second optic member therein, an optical axis of the first optic member inclined with respect to an optical axis of the second optic member, light emitted from the light source emits from the bottom surface after being sequentially refracted by the second optic member and the first optic member;

wherein the main board has an incident end wall arranged away from the base board, the incident end wall defines a receiving aperture, the receiving aperture receives the printed circuit board, and the light source faces a convex surface of the second optic member.

7. The illumination assembly as claimed in claim 6, wherein the main board defines a cavity, a transparent inclined separating wall is formed between the receiving aperture and the cavity, the second optic member is arranged on the transparent inclined separating wall.

8. The illumination assembly as claimed in claim 7, wherein a reflecting layer is printed on the inner wall of the receiving aperture, and used to reflect light to the second optic member.

9. The illumination assembly as claimed in claim 8, wherein the reflecting layer has a waved cross-section.

10. The illumination assembly as claimed in claim 6, wherein the first optic member is a convex lens.

11. The illumination assembly as claimed in claim 6, wherein the optic second member is a convex lens.

12. A light guiding pole, comprising:

a base board having a top surface and a bottom surface, a first optic member being arranged on the top surface; and a main board mounted to the top surface of the base board, adjacent to the first optic member, the main board arranging a second optic member therein;

wherein an optical axis of the first optic member is angled with respect to an optical axis of the second optic member, the second optic member faces away from the first optic member, light emitted from a light source emits from the bottom surface after being sequentially refracted by the second optic member and the first optic member;

wherein the main board defines a cavity, the main board has an incident end wall arranged away from the base board, the incident end wall defines a receiving aperture and forms a transparent inclined separating wall between the receiving aperture and the cavity, and the second optic member is arranged on the transparent inclined separating wall.

13. The light guiding pole as claimed in claim 12, wherein the inclined separating wall includes a first surface facing the cavity and an opposite second surface facing the receiving aperture, the second optic member is attached to the second surface.

14. The light guiding pole as claimed in claim 12, wherein a reflecting layer is printed on the inner wall of the receiving aperture, and used to reflect a portion of the light to the second optic member.

15. The light guiding pole as claimed in claim 14, wherein the reflecting layer has a waved cross-section.

16. The light guiding pole as claimed in claim 12, wherein the first optic member is a convex lens.

17. The light guiding pole as claimed in claim 12, wherein the second optic member is a convex lens.

* * * * *